US006857869B1

(12) United States Patent
Sun

(10) Patent No.: US 6,857,869 B1
(45) Date of Patent: Feb. 22, 2005

(54) REFILLABLE CANDLE STAND

(76) Inventor: Cheng-Seu Sun, No. 22-2, Alley 20, Lane 49, Chuangching Rd., Chungho City, Taipei Hsien (TW)

( * ) Notice: Subject to any disclaimer, the term of this patent is extended or adjusted under 35 U.S.C. 154(b) by 0 days.

(21) Appl. No.: 10/838,729

(22) Filed: May 3, 2004

(30) Foreign Application Priority Data

Apr. 1, 2004 (TW) ..... 093204954

(51) Int. Cl.[7] ..... F23D 3/16
(52) U.S. Cl. ..... 431/289; 431/291; 431/292
(58) Field of Search ..... 431/288, 291, 431/292, 298, 289, 315, 325; 362/161, 181, 182

(56) References Cited

U.S. PATENT DOCUMENTS 3,910,753 A * 10/1975 Lee ..... 431/290
4,206,500 A * 6/1980 Neil ..... 362/161
5,078,945 A * 1/1992 Byron ..... 264/278
5,980,241 A * 11/1999 Schirneker ..... 431/291
2001/0005573 A1 * 6/2001 Furner et al. ..... 431/292
2004/0033464 A1 * 2/2004 Pesu et al. ..... 431/289

* cited by examiner

*Primary Examiner*—James C. Yeung
(74) *Attorney, Agent, or Firm*—Alan D. Kamrath; Nikolai & Mersereau, P.A.

(57) ABSTRACT

A candle stand includes a container and a bowl supported by an inner periphery of the container and having a hollow column formed on top of the bowl. The hollow column has multiple pawls each having a bend formed on a free end of the pawl and extending toward a central axis of the hollow column so as to clamp a wick. Multiple through holes are defined through a base of the bowl, wherein a space is defined between a bottom face of the container and the base of the bowl for receiving liquefied wax.

6 Claims, 4 Drawing Sheets

REFILLABLE CANDLE STAND

BACKGROUND OF THE INVENTION

1. Field of the Invention

The present invention relates to a candle stand, and more particularly to a candle stand which is able to be refilled easily with molten candle wax when the liquid candle wax in the candle stand has burned out.

2. Description of Related Art

Normally, a candle stand has a closed end and an open end, wherein a candle is placed on top of the closed end. After the candle has burned out, the user will have to place a new candle in the candle stand. However, when the open end of the candle stand is too narrow to allow the user to place a new candle inside the candle stand, or it is impossible for the user to use a new candle especially when the candle stand contains therein liquid candle wax, the candle stand's useful life is restricted. It is to be noted that when the candle stand contains therein liquid candle wax, it is not possible for the user to refill the candle stand with the liquid candle wax in that the liquid candle wax is normally sealed inside the candle stand. Therefore, when the liquid candle wax is burned out, the user can only treat the candle stand as waste, which is a waste of material and money.

To overcome the shortcomings, the present invention tends to provide an improved candle stand to mitigate the aforementioned problems.

SUMMARY OF THE INVENTION

The primary objective of the present invention is to provide an improved candle stand to allow the user to refill easily the candle stand with molten wax.

Another objective of the present invention is that the candle has pawls to support the wick and to concentrate the flame when the wick is lit.

Other objects, advantages and novel features of the invention will become more apparent from the following detailed description when taken in conjunction with the accompanying drawings.

DETAILED DESCRIPTION OF THE PREFERRED EMBODIMENT

Figure 1:
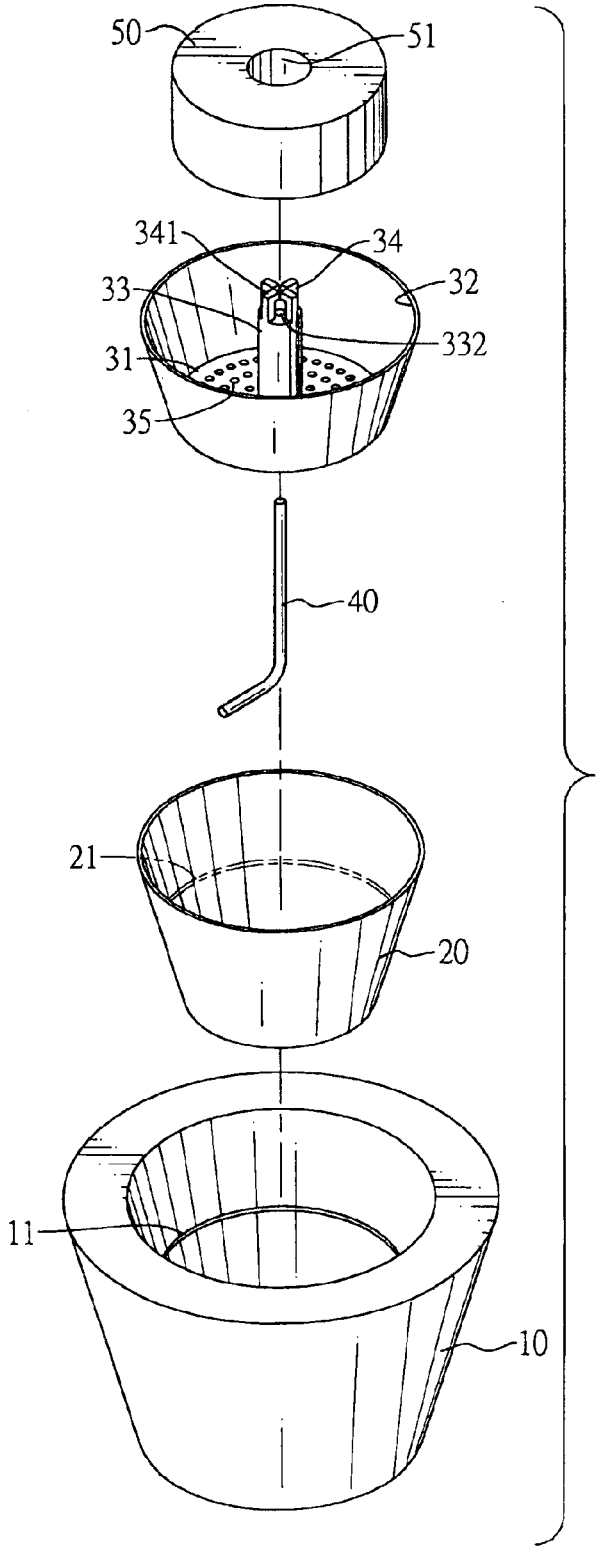
FIG. 1 is an exploded perspective view showing the elements of the candle stand of the present invention.

With reference to FIG. 1, the candle stand in accordance with the present invention has a container (10) with a closed end and an open end, a conducting layer (29) detachably received in the container (10) from the open end of the container (10) and having an open end and a closed end and a bowl (30) detachably mounted on and supported by a periphery of the conducting layer (20).

The container (10) may be made of a transparent material, preferably glass. The container (10) may have a circumferential boss (11) formed on an inner circumference of the container (10). The conducting layer (20) is optionally received in the container (10) and preferably made of brass, iron or aluminum.

In order to support the bowl (30), the conducting layer (20) has a peripheral flange (21) formed on an inner periphery of the conducting layer (20) such that when the bowl (30) is placed in the conducting layer (20), the bowl (30) is supported by the peripheral flange (21).

The bowl (30) has a side wall (32) integrally formed with a base (31) and engaged with the inner periphery of the conducting layer (20). The bowl (30) has a hollow column (33) centrally formed on top of the base (31) and defining therein a path (331) (as shown in FIG. 3) in communication with surrounding air and multiple through holes (35) defined through the base (31).

At the free end of the hollow column (33), multiple cutouts (332) are defined and thus multiple pawls (34) are formed on the free end of the hollow column (33). Each pawl (34) has a bend (341) formed on a free end of the pawl (34). A wick (40) is provided to be received in and extended out of the path (331) in the hollow column (33). A wax disc (50) having a centrally defined hole (51) to correspond to the hollow column (33) is to be supported by the base (31) of the bowl (30).

Figure 2:
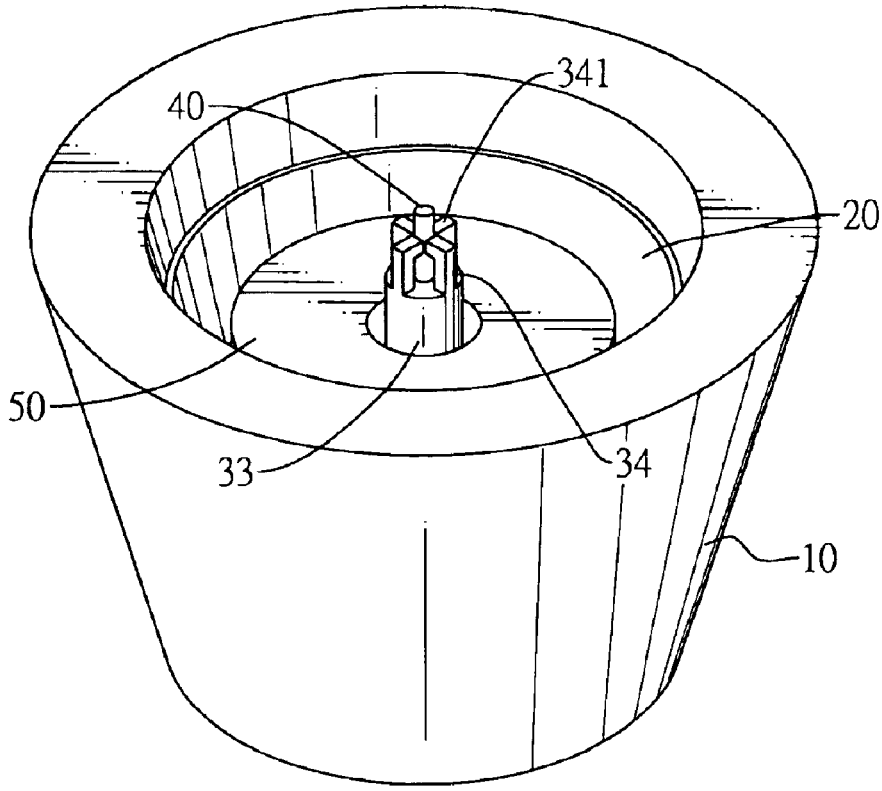
FIG. 2 is a perspective view showing the assembly of the present invention.
Figure 3:
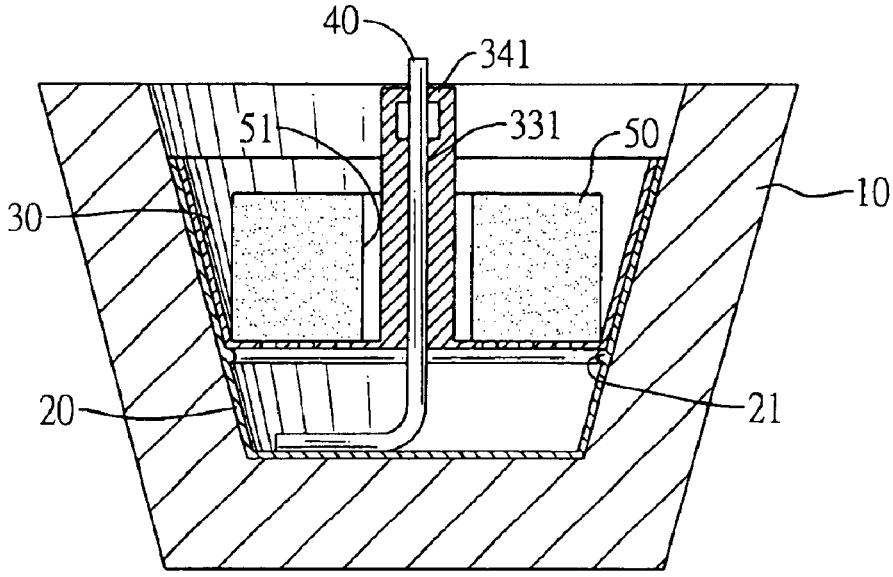
FIG. 3 is a cross sectional view showing the inner structure of the candle stand of the present invention, wherein the bowl is supported by a flange formed on an inner periphery of the conducting layer.

With reference to FIGS. 2 and 3, it is noted that when the candle stand of the present invention is assembled, the conducting layer (20) is received in the container (10) and then the bowl (30) is supported by the peripheral flange (21) of the conducting layer, (20) with the wick (40) extending out of the hollow column (33) from the path (331) and supported by the bends (341) of the pawls (34). Thereafter, the wax (50) is received in the bowl (30) with the hollow column (33) extending through the hole (51) of the wax (50).

Figure 4:
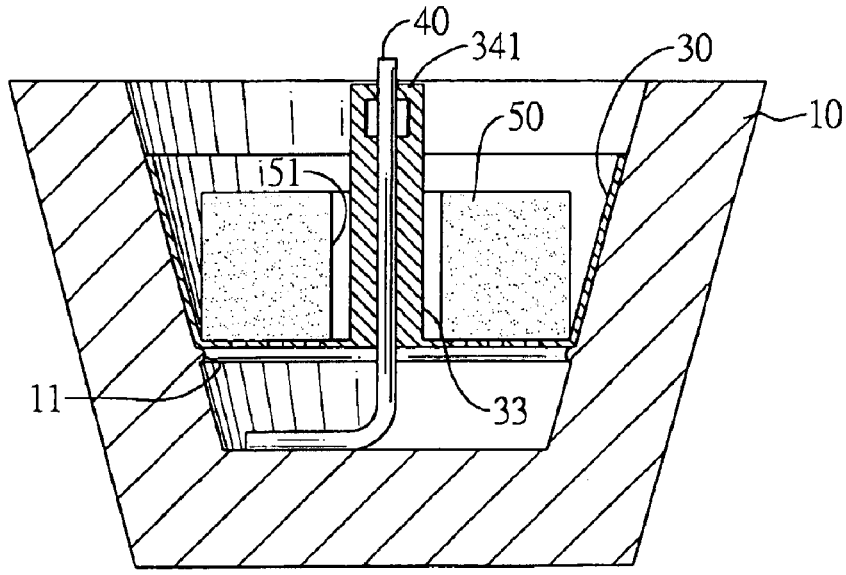
FIG. 4 is a cross sectional view showing that the conducting layer is removed and only the bowl is left inside the container and supported by a flange formed on an inner periphery of the container.

With reference to FIG. 4, it is noted that the conducting layer (20) may be removed from the assembly and the bowl (30) is supported by the circumferential boss (11) of the container (10). That is, in different embodiments of the present invention, the peripheral flange (21) of the conducting layer (20) may be provided to support the bowl (30) and the circumferential boss (11) of the container (10) may be provided to support the bowl (30) when the conducting layer (20) is removed.

Figure 5:
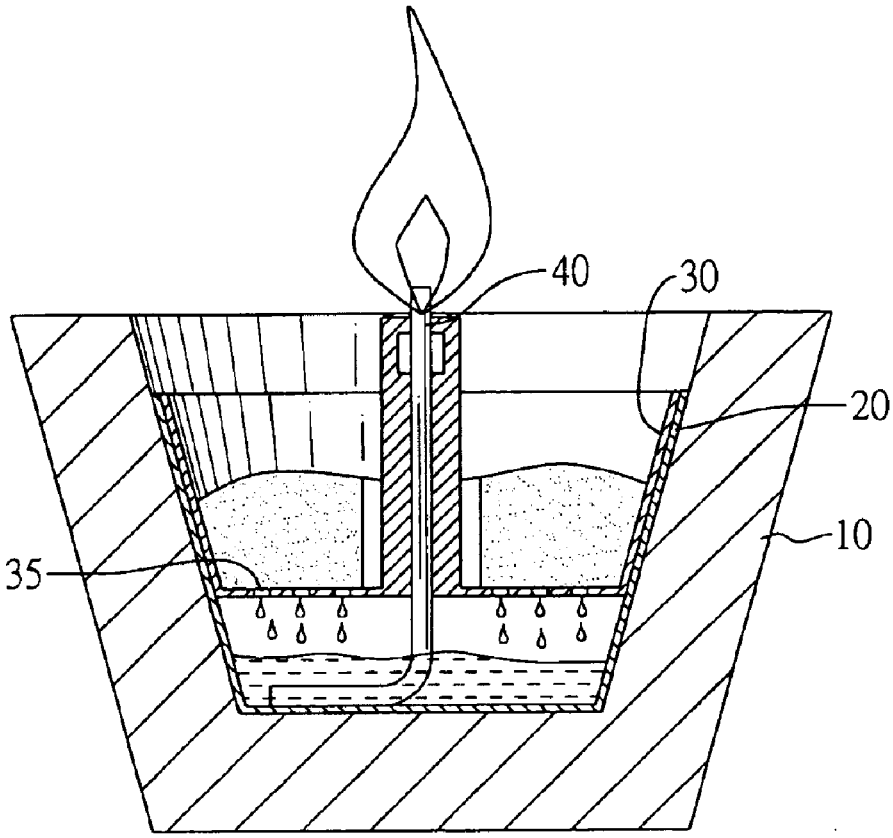
FIG. 5 is a schematic cross sectional view showing the application of the candle stand of the present invention.

With reference to FIG. 5, it is noted that after the assembly of the present invention is finished and when the wick (40) is lit, the bends (341) are able to concentrate the flame of the wick (40). Furthermore, due to the heat conduction in the bowl (30) and the conducting layer (20), the heat from the flame will melt the wax disc (50) from an outermost periphery of the wax disc (50). After a portion of the solid wax disc (50) becomes liquefied wax (50), the liquefied wax (50) flows through the through holes (35) in the base (31) of the bowl (30) and into a space defined between a bottom face of the conducting layer (20) and a bottom face of the base (31) of the bowl (30). That is, if there is a little liquefied wax in the space and is about to be burned out, the user is able to place a solid wax disc (50) on top of the bowl (30) to use the heat of the flame to liquefy the solid wax disc (50). Once a portion of the solid wax disc (50) has become liquefied, the liquefied wax (50) flowing to the space functions as a refill of the liquefied wax received in the space.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A candle stand comprising:

a container having a closed end and an open end; and a bowl supported by an inner periphery of the container and having a hollow column formed on top of the bowl and having multiple pawls formed on a free end of the hollow column and each pawl having a bend formed on a free end of the pawl and extending toward a central axis of the hollow column so as to clamp a wick and multiple through holes defined through a base of the bowl, wherein a space is defined between a bottom face of the container and the base of the bowl for receiving liquefied wax.

2. The candle stand as claimed in claim 1, wherein the container has a circumferential boss formed on the inner periphery of the container to support the bowl.

3. The candle stand as claimed in claim 1 further comprising a conducting layer sandwiched between the bowl and the container.

4. The candle stand as claimed in claim 3, wherein the conducting layer has a peripheral flange formed on an inner periphery of the conducting layer to support the bowl.

5. A candle stand comprising:

a container having a closed end and an open end;

a conducting layer received in the container from the open end of the container;

a bowl supported by an inner periphery of the conducting layer and having a hollow column formed on top of the bowl and provided with multiple pawls formed on a free end of the hollow column, each pawl having a bend formed on a free end of the pawl and extending toward a central axis of the hollow column so as to clamp a wick and multiple through holes defined through a base of the bowl, wherein a space is defined between a bottom face of the container and the base of the bowl to receive liquefied wax; and a wax disk supported by the base of the bowl and having a hole defined to allow an extension of the hollow column.

6. The candle stand as claimed in claim 5, wherein the conducting layer having a peripheral flange formed on an inner periphery of the conducting layer to support the bowl.

* * * * *